United States Patent [19]

Tiers et al.

[11] 4,447,521

[45] May 8, 1984

[54] FIXING OF TETRA(HYDROCARBYL)BORATE SALT IMAGING SYSTEMS

[75] Inventors: George V. D. Tiers, St. Paul; Steven M. Aasen, Lakeland, both of Minn.; Rex J. Dalzell, Sommerset, Wis.; Brian N. Holmes, Oakdale, Minn.

[73] Assignee: Minnesota Mining and Manufacturing Company, St. Paul, Minn.

[21] Appl. No.: 436,266

[22] Filed: Oct. 25, 1982

[51] Int. Cl.[3] ..... G03C 1/52

[52] U.S. Cl. ..... 430/337; 430/339

[58] Field of Search ..... 430/339, 337

[56] References Cited

U.S. PATENT DOCUMENTS

| | | | |
|---|---|---|---|
| 3,567,453 | 3/1971 | Borden | 430/163 |
| 3,716,366 | 2/1973 | Riester | 430/338 |
| 3,754,921 | 8/1973 | Riester | 430/338 |
| 4,307,182 | 12/1981 | Dalzell et al. | 430/339 |
| 4,343,891 | 8/1982 | Aasen et al. | 430/339 |

FOREIGN PATENT DOCUMENTS

| | | |
|---|---|---|
| 1370058 | 10/1974 | United Kingdom . |
| 1370059 | 10/1974 | United Kingdom . |
| 1370060 | 10/1974 | United Kingdom . |
| 1386269 | 3/1975 | United Kingdom . |

*Primary Examiner*—Won H. Louie, Jr.

*Attorney, Agent, or Firm*—Donald M. Sell; James A. Smith; Mark A. Litman

[57] ABSTRACT

Imaging systems comprising a tetra(hydrocarbyl)borate and a bleachable dye may be rendered desensitizable by the inclusion of a second bleachable dye which absorbs radiation in a different portion of the electromagnetic spectrum than the first bleachable dye.

16 Claims, No Drawings

FIXING OF TETRA(HYDROCARBYL)BORATE SALT IMAGING SYSTEMS

FIELD OF THE INVENTION

This invention relates to imaging processes and in particular to dye bleaching image forming systems. A light sensitive system comprising a dye and a tetra(hydrocarbyl)borate is constructed so as to be rendered light-insensitive, i.e., fixed, after development.

BACKGROUND OF THE INVENTION

There exists a vast array of imaging systems having a multitude of various constructions and compositions. Amongst the more widely used systems are silver halide light sensitive systems (including black and white and color photography, dry silver photothermography, instant photography, and diffusion transfer systems, amongst others), photopolymeric systems (including planographic and relief printing plates, photoresist etching systems, and imaging transfer systems), diazonium color coupling systems, and others. Each system has its own properties attributable to the phenomenon which forms the basis of the imaging technology. For example, silver halide imaging systems are noted both for amplification (i.e., image densities which can be increased by further development without additional imagewise exposure) due to the catalytic action of silver towards the reduction of silver ion and for the fact that light sensitivity may be stopped after development by washing away the light sensitive silver halide salt (i.e., fixing). Photopolymeric systems are noted for image stability and ease of application of the imaging layer. Diazonium color coupling systems have high image resolution and are easy to coat onto supporting substrates.

One other type of imaging system which has received some attention in recent years uses a salt comprising an aromatic tetra(hydrocarbyl)borate anion as a dye-bleaching or solubility-altering photosensitive compound. U.S. Pat. No. 3,567,453 discloses the use of such borate salts (having at least one aryl substituent on the borate) in photoresist and lithographic compositions. U.S. Pat. No. 3,754,921 discloses an imaging system comprising a leucophthalocyanine and "phenylboronate". U.S. Pat. No. 3,716,366 even indicates that image stabilization might be achieved by reaction or dissolution and removal of one of the components (column 5, lines 1–8). British Pat. Nos. 1,370,058; 1,370,059; 1,370,060; and 1,386,269 also disclose dye bleaching processes using aromatic borates as light sensitive agents. U.S. Pat. No. 4,307,182 shows a wide range of constructions for tetra(aliphatic)borate imaging systems.

U.S. Pat. No. 3,716,366 suggests that desensitization may be effected by reactions with one of the components to form stable colorless products, and specifically suggests selectively dissolving out one of the components. No specific reagents or reaction mechanisms are suggested for the desensitization process, however.

U.S. Pat. No. 4,343,891 describes a process for fixing tetra(hydrocarbyl)borates by chemical reaction of the borate.

SUMMARY OF THE INVENTION

It has been found that light sensitive imaging systems having a tetra(hydrocarbyl)borate as a light sensitive component thereof may be rendered light insensitive, particularly after imaging has been effected, by reacting the borate with a non-visible image-forming dye in reactive association with the borate within the imaging system. The most generally useful borate containing light sensitive systems comprise a borate and a dye in reactive association, usually in a binder. Cationic dyes are particularly useful in such construction.

DETAILED DESCRIPTION OF THE INVENTION

Borates are variously referred to in the art as borates, boronates, boronides and by other chemical terms. In the practice of the present invention borates are strictly defined as tetra(hydrocarbyl)borates, that is, a compound having four carbon-to-boron bonds. These compounds may be represented by the formula:

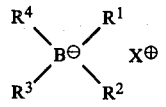

wherein $R^1$, $R^2$, $R^3$, and $R^4$ are independently any groups bonded to the boron from a carbon atom, and $X^{\oplus}$ is any cation except for $H^{\oplus}$ and other boron-carbon bond cleaving cations.

The groups $R^1$, $R^2$, $R^3$, and $R^4$ may be independently selected from such groups as alkyl, aryl, alkaryl, allyl, arylalkyl, alkenyl, alkynyl, cyano, heterocyclic rings, alkyl-heterocyclic rings, etc. Any group bonded to the boron from a carbon atom is useful. When these substituents are referred to as groups, i.e., alkyl group versus alkyl, that nomenclature specifically is defined as allowing for substitution on the alkyl moiety (e.g., ether or thioether linkages in the alkyl chain, halogen, cyano, vinyl, acyloxy, or hydroxy substitution, etc.), remembering that the group must be bonded to the boron from a carbon atom. Thus, alkoxy and phenoxy would not be included. Cycloaliphatic groups are included in the definitions, as are heterocyclic groups bonded to the boron from a ring carbon atom or through an alkyl linkage (i.e., alkyl-heterocyclic). It is preferred that the R groups be selected from aryl (e.g., phenyl or naphthyl groups), alkyl (e.g., methyl, octyl, octadecyl), alkenyl, alkynyl, allyl, and aralkyl (e.g., benzyl) groups. Preferably these groups contain no more than 20 carbon atoms. More preferably they contain no more than 12 carbon atoms and most preferably no more than 8 carbon atoms. Cyano is the least preferred aliphatic group.

The more preferred borates are those having at least three aliphatic groups bonded to the boron, and the most preferred borates have four aliphatic groups bonded to the boron.

Any cation may be used in association with the borate except for cations which break at least one carbon to boron bond on the borate, e.g., $H^+$. As a standard test, one could limit the cations to those which do not break at least one carbon to boron bond of tetraphenylborate. This can be readily determined by standard analytical techniques such as gas chromatography, infrared or mass spectrometry, nuclear magnetic resonance, etc. It is highly preferred that the cations, if they are metal cations, be less readily reducible than ferric ions. Readily reducible metal ions are undesirable as they tend to react with the borate. Organic cations are preferred. The nature of the cation has not been found to be critical in the practice of the present invention. The most significant contribution of the cation is its effects upon solubility in different solvents or binders. The cations may range from simple elemental cations such as alkali metal cations (e.g., $Li^+$, $Na^+$. and $K^+$) to complex cationic dyes and quaternary ammonium cations, e.g., such as represented by the formula:

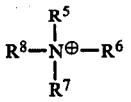

wherein $R^5$, $R^6$, $R^7$, and $R^8$ are independently selected from aliphatic (e.g., alkyl and particularly alkyl of 1 to 12 or preferably 1 to 4 carbon atoms), aryl (e.g., phenyl and naphthyl groups), and aralkyl (e.g., benzyl groups). For example, tetramethyl, tetraethyl, tetrapropyl, tetrabutyl and triethylmonomethyl ammonium are particularly useful. Cations such as phenyltrimethylammonium and benzyltriethylammonium are also quite satisfactory as are phosphonium and sulfoniums. Quaternary cations in more complex forms such as N-alkyl heterocyclic cations such as

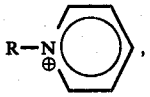

quaternary dyes and quaternized groups in polymer chains are useful. The polymers, for example, could contain repeating groups such as:

a.

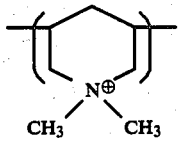

b.

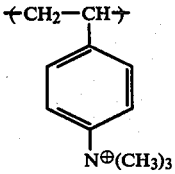

c.

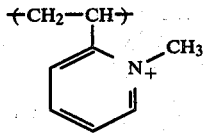

d.

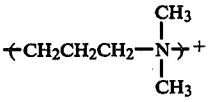

and e.

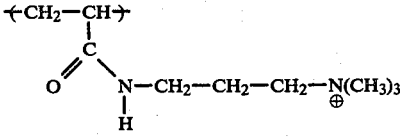

With the proper selection of the quaternary ammonium cations, such polymeric materials could also serve as binders for the system.

The dyes, for example, may be of any color and any chemical class. These dyes, of course, should not contain groups which would react with the borate salts without light exposure (e.g., free carboxylic acid groups, free sulfonic acid groups, or metal ions more readily than or as readily reducible as ferric ion). Any dye photobleachable by borates may be used in the practice of the present invention. Specific classes of dyes useful in the practice of the present invention include methines, triarylmethanes, cyanines, ketomethylenes, styryls, xanthenes, azines, carbocyanines, butadienyls, azomethines, etc. The following are specific examples of dyes used in the practice of the present invention:

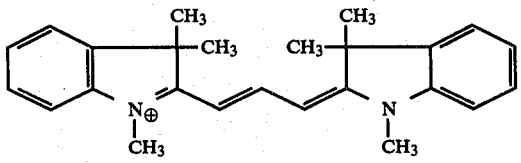

(magenta dye cation, Indolenine Red)

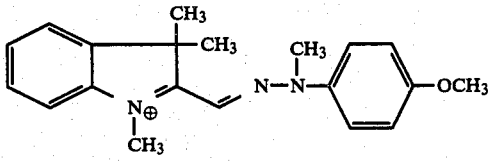

(yellow dye cation)

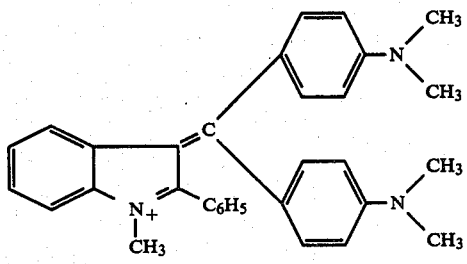

(cyan dye cation)

Cationic dyes are the most preferred and when they have been used, a slight excess of borate anion is desired to provide complete bleaching.

The cationic dyes may have anions other than borates, such as the ionic dyes of the formula:

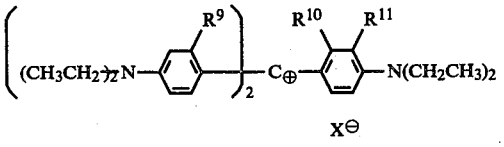

wherein $X^-$ is any anion including, for example, $Cl^-$, $I^-$, $Br^-$ perfluoro(4-ethylcyclohexane)sulfonate (referred to as PECHS, herein), sulfate, methyl sulfate, methanesulfonate, etc.

$R^9$ and $R^{10}$ are independently H, alkyl or alkoxy (preferably 1 to 12 carbon atoms and most preferably 1 to 4 carbon atoms), F, Cl, Br, and I, and $R^{11}$ is H or alkyl, preferably of 1 to 12 and most preferably 1 to 4 carbon atoms, or halogen. Any cationic dye may be useful in the practice of the present invention, and their listing is merely cumulative.

Imaging in the light-sensitive systems comprising tetra(hydrocarbyl)borate, dye and binder is effected by irradiation. The radiation which is absorbed by the dye-borate system causes the dye to bleach. A positive-acting imaging process is thus effected. The use of cationic dyes is believed to cause spectral absorption of radiation enabling the dyes to react with the borates. The dyes associated with the borate are not spectral sensitizers as understood in the photographic silver halide sense and are not used as sensitizing dyes are used in photographic imaging systems (the latter are usually in ratios of 1/500 or 1/10,000 of dye to light sensitive agents). The present dyes are used in proportions of at least 1/10 to about 1/1 in ratio to the borates. Because the dye-borate system combines the spectrally sensitive element and the image forming element at a molecular level, a multiplicity of colored dyes may be used (e.g., cyan, magenta, and yellow) in the same or different layers or in dispersed particles or droplets.

The above-described spectral sensitivity relationship between the dyes and the borates is important to the practice of the present invention. By incorporating additional dye or dyes in the element, a light-activated fixing function may be provided to the element. For example, if an element were constructed which was intended to provide a blue image only (absorbing the red, yellow, and green sections of the spectrum), it would ordinarly contain only a blue dye in a ratio to borate that would not exceed 1:1. If a yellow dye were also included in the element in a ratio of at least 1:1 with the borate, the element could readily be desensitized or fixed in the following manner. The positive-acting imaging film would first be imagewise exposed (and thereby developed) typically to yellow light to form the final image. After the image is formed, the film would be uniformly exposed to blue light to fix the element. The yellow dye would absorb the blue photons and be at least partially bleached by the remaining borate, effectively deactivating all of the borate in the film. After this second exposure, the film would no longer be light sensitive and would retain the blue positive image.

Because of the mechanism of the reaction and the order of the steps, if a second visible dye is used to react with the borate, all of that second visible dye will not be bleached in the area where the first visible dye was bleached. This leads to final images with different colors in the image and background, for there cannot always be enough borate in one area to bleach both the image forming dye and the second visible dye. This is not necessarily an undesirable effect, because with proper choice of the dyes, the second dye need not interfere with the image information presented by the first dye, and images with colored backgrounds are quite useful. Ordinarily in such a system, the total amount of dye present should be in a ratio of at least 1.1 moles dye1.0 moles of borate up to a practical maximum of about 2 or 3 moles dye/1.0 moles borate. The moles of dye include the sum of both the image forming dye and the distinct, differently colored second (desensitizing) dye. Where the intended use is for visual presentation, it is preferable to have significant visible contrast between the dyes so as to provide a distinct image. Combinations such as cyan/yellow, yellow/cyan, yellow/magenta, cyan/magenta, green/cyan, green/yellow, etc. are examples of the type of combinations which would provide significant visible contrast between the colors of the dyes. The image dye should be present in sufficient quantity to provide an optical density of at least 0.1, preferably at least 0.3 or 0.5, and most preferably at least 1.0. For many uses, the optical density need not be within the visible regions of the spectrum. Dyes may be used, for example, with absorption peaks in different regions of the ultraviolet range.

Generally, visual images are preferred on a white or transparent background. It is therefore necessary to provide a system which will not be colored in the background. This would be difficult to do if solely visible dyes were used since the various uses would differ greatly in the amount of image dye bleached in different parts of the image and would require almost a predetermined imagewise distribution of the visible desensitizing dye in order to react properly with the borate. This problem can be minimized or completely eliminated by using a dye which absorbs little or no radiation in the visible region of the spectrum but has absorption peaks in the near ultraviolet, far ultraviolet, or near infrared, positions of the spectrum. These regions will be collectively referred to as the ultraviolet and infrared. By using dyes which do not absorb strongly in the visible portion of the spectrum, background images are not a problem; the dyes are only slightly visible or invisible to begin with. The borate may then be reacted and deactivated by exposing the element to the particular radiation which the ultraviolet or infrared absorbing dye absorbs. The borate then reacts with and bleaches the dye giving another non-visible light absorbing species and is thereby spent. By exposing the entire sheet to that radiation after imaging has been performed, all of the borate will be deactivated.

It is generally preferable to have this non-visible desensitizing dye present in a molar amount in a ratio of at least 0.8 moles dye/mole borate. More preferably the desensitizing dye would be present in a molar ratio of at least 0.9/1.0 dye/borate and most preferably at least 1.0/1.0. As the dye tends to be invisible, the upper limit depends only upon the dye's solubility, the structural requirements of the layer (too much dye may render the layer physically weak), and the relative invisibility of the dye. Molar ratios of dye/borate of 10/1, for example, would be possible in certain circumstances.

When the dye has been termed non-visible, it is intended that this allows for some absorbance within the visible spectrum, in addition to its absorption in the infrared and ultraviolet. This is actually quite common for dyes which strongly absorb in those positions of the electromagnetic spectrum. Generally the term "non-visible" as used in the practice of this present invention means that the dye, as it appears in the element, does not provide an image density of greater than 0.3 in the visible region of the spectrum. Preferably, the desensitizing dye, as opposed to the image forming dye would have an optical density of less than 0.20 and more preferably less than 0.10 in the visible portions of the spectrum.

The borate should generally be present as at least 0.2% by weight of the layer and preferably in excess of 0.3%. Smaller percentages may be preferably with especially thick layers as may be used in holography.

These and other aspects of the present invention will be shown in the following examples.

EXAMPLE 1

The following solution was prepared and coated at three (3) mils wet thickness onto 2 mil polyester sheet:

(1) 5 ml of a 10% solid solution of a methylacrylate/methylmethacrylate copolymer having a glass transition temperature of 45° C. in methylethylketone/toluene (3/1 weight mixture), 30 mg of tributylphenylboratetetrabutyl ammonium salt, 30 mg of the cyan dye

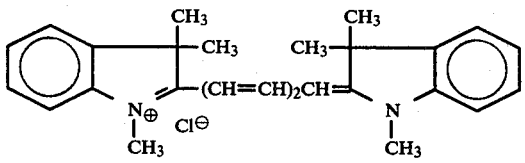

and 60 mg of the ultraviolet radiation absorbing dye

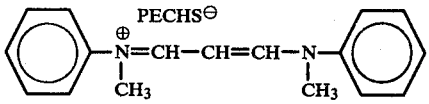

The sample was air dried, exposed imagewise to predominantly red light and then exposed to a hand-held mercury-vapor ultraviolet lamp for 2 to 3 minutes. Substantial fixation occurred which was indicated by the stability of the visible image to white light.

EXAMPLE 2

The following solution was prepared and coated at 3 mil wet thickness onto 2.5 mil polyester sheet:

(1) 5 mil of a 10% by weight solution of a methylacrylate/methylmethacrylate copolymer with a glass transition temperature of 45° C. in methylethylketone/toluene (3:1 weight ratio), 45 mg tetrabutylborate-tetrabutyl ammonium salt, 45 mg of the magenta dye

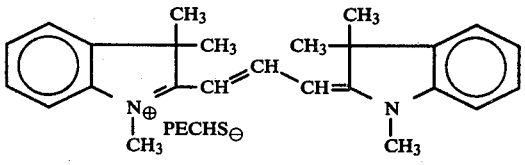

and 90 mg of the same ultraviolet radiation absorbing dye used in Example 1.

After air drying, the element was exposed imagewise to predominantly green light, and then was exposed to a hand-held mercury-vapor ultraviolet lamp for 2 to 3 minutes. Substantial fixation occurred.

The binders useful in the present invention must be transparent or at least translucent to the active wavelengths of light. According to some practices of the present invention, the layers need not be penetrable by solvents or gases. Binders such as natural resins (e.g., gelatin, gum arabic, etc.), synthetic resins (e.g., polyacrylates, polyvinyl acetals, cellulose esters, polyamides, polycarbonates, polyolefins, polyurethanes, polyepoxides, polyoxyalkylenes, polyvinylhalides, polysiloxanes, polyvinylacetate, polyvinyl alcohol, etc.), and other media may be used. The binders may be thermoplastic or substantially crosslinked.

If an imagewise exposure of the desensitizing dye is first made, with a subsequent general exposure of the element to white light or light absorbed by the image dye, a negative visible image can be formed. Care would ordinarily be taken to avoid use in the second exposure of radiation that would be absorbed by the desensitizing dye.

It is not intended that the use of terms such as "visible" should restrict the invention to only those uses in which the images are examined by the human eye. By suitable choice of the imaging and densensitizing dyes, a wide variety of exposing radiations may be used. Furthermore, the use of physical, chemical and biological detectors of radiation other than human vision make it possible to use dyes which would be invisible to the human eye.

Normally, it is preferable to ensure that the spectral absorption band of the image and desensitizing dyes do not overlap at the wave lengths used respectively for exposure and fixing. However, as long as considerable difference in absorption exists in those two areas of the spectrum, usable imaging properties will be present.

We claim:

1. A desensitizable and imageable article having at least one layer comprising a tetra(hydrocarbyl)borate, a first bleachable dye, and a second bleachable dye present in a molar ratio of at least 0.8/1.0 with respect to said borate and said first bleachable dye providing an optical density to said sheet, and having a spectral absorption curve different from the said second bleachable dye wherein said second bleachable dye is a substantially non-visible dye absorbing in the infrared or ultraviolet regions of the spectrum.

2. The article of claim 1 wherein said second bleachable dye provides a visible optical density of less than 0.2.

3. The article of claim 1 wherein said tetra(hydrocarbyl)borate is a tetra(aliphatic)borate.

4. The article of claim 3 wherein said tetra(aliphatic)borate is a tetra(alkyl)borate.

5. The article of claim 1 wherein said non-visible dye absorbs strongly in the ultraviolet region of the spectrum and said first bleachable dye is present in an amount that provides an optical density of at least 0.3 in the visible region of the spectrum.

6. The article of claim 2 wherein said non-visible dye absorbs strongly in the ultraviolet region of the spectrum and said first bleachable dye is present in an amount that provides an optical density of at least 0.3 in the visible region of the spectrum.

7. The article of claim 3 wherein said non-visible dye absorbs strongly in the ultraviolet region of the spectrum and said first bleachable dye is present in an amount that provides an optical density of at least 0.3 in the visible region of the spectrum.

8. The article of claim 4 wherein said non-visible dye absorbs strongly in the ultraviolet region of the spectrum and said first bleachable dye is present in an amount that provides an optical density of at least 0.3 in the visible region of the spectrum.

9. A process comprising exposing a desensitizable and imageable article having at least one layer comprising a tetra(hydrocarbyl)borate, a first bleachable dye, and a second bleachable dye present in a molar ratio of at least 0.8/1.0 with respect to said borate and said first bleachable dye providing an optical density to said sheet, and having a spectral absorption curve different from the said second bleachable dye to an imagewise distribution of radiation to bleach said first bleachable dye in an imagewise fashion and then generally exposing said article to radiation to bleach said second bleachable dye.

10. The process of claim 9 wherein said exposing to bleach said second bleach dye desensitizes the majority of the borate remaining in said article after the imagewise exposure.

11. The process of claim 9 wherein said second bleachable dye is a substantially non-visible dye absorbing in the infrared or ultraviolet regions of the spectrum.

12. The process of claim 10 wherein said second bleachable dye is a substantially non-visible dye absorbing in the infrared or ultraviolet regions of the spectrum.

13. The process of claim 9 wherein said tetra(hydrocarbyl)borate is a tetra(aliphatic)borate.

14. The process of claim 10 wherein said tetra(aliphatic)borate is a tetra(alkyl)borate.

15. The process of claim 12 wherein said tetra(hydrocarbyl)borate is a tetra(aliphatic)borate.

16. The process of claim 15 wherein said tetra(aliphatic)borate is a tetra(alkyl)borate.

* * * * *

UNITED STATES PATENT AND TRADEMARK OFFICE

CERTIFICATE OF CORRECTION

PATENT NO. : 4,447,521

DATED : May 8, 1984

INVENTOR(S) : George V. D. Tiers, Steven M. Aasen, Rex J. Dalzell, Brian N. Holmes It is certified that error appears in the above-identified patent and that said Letters Patent is hereby corrected as shown below:

Col. 5, line 63, "moles dye 1.0 moles" should read --moles dye/1.0 moles--.

Signed and Sealed this

*Twenty-fifth* Day of *June 1985*

[SEAL]

*Attest:*

DONALD J. QUIGG

*Attesting Officer*

*Acting Commissioner of Patents and Trademarks*